US005474295A

United States Patent [19]

Demshuk

[11] Patent Number: 5,474,295

[45] Date of Patent: Dec. 12, 1995

[54] GAME APPARATUS FOR THE HANDICAPPED

[76] Inventor: Thomas Demshuk, 3464 Sharon Way, Williamston, Mich. 48895

[21] Appl. No.: 294,022

[22] Filed: Aug. 24, 1994

[51] Int. Cl.[6] ..... A63F 5/04

[52] U.S. Cl. ..... 273/141 A; 623/24; 434/112

[58] Field of Search ..... 273/141 A, 141 R, 273/DIG. 27; 623/24; 434/112

[56] References Cited

U.S. PATENT DOCUMENTS

| | | | |
|---|---|---|---|
| 2,799,500 | 7/1957 | Zekowski | 273/141 A |
| 3,272,511 | 9/1966 | Zarich | 273/141 A |
| 3,458,200 | 7/1969 | D'elia et al. | 273/141 R |
| 3,545,758 | 12/1970 | Payne | 273/94 |
| 3,656,754 | 4/1972 | Clark | 273/141 A |
| 3,669,453 | 6/1972 | DuBois et al. | 273/141 A |
| 3,733,074 | 5/1973 | Daley | 273/238 |
| 3,834,711 | 9/1974 | Breslow | 273/141 A |
| 3,841,637 | 10/1974 | Piazza et al. | 273/141 A |
| 3,853,322 | 12/1974 | Mercer | 273/141 R |
| 3,933,357 | 1/1976 | Mercer et al. | 273/141 R |
| 3,967,825 | 7/1976 | Anania | 273/141 R |
| 4,848,768 | 7/1989 | Barlow | 273/141 A |
| 4,865,610 | 9/1989 | Muller | 623/24 |

FOREIGN PATENT DOCUMENTS

| | | | |
|---|---|---|---|
| 1242861 | 2/1961 | France | 273/27 |

OTHER PUBLICATIONS

Catalog—Toys for Special Children —Enabling Devices, 1994.

Catalog—Able Net Inc., 1994–95 (and pp. 6–7 from another Able Net catalog).

Catalog—Don Johnston Incorporated, 1994.

Catalog—Communication Aids for Children and Adults, Crestwood Company, 1994.

ABLEDATA search report, Feb. 8, 1995.

*Primary Examiner*—Benjamin H. Layno
*Attorney, Agent, or Firm*—Oliff & Berridge

[57] ABSTRACT

A game apparatus provides for participation in table games by persons having physical and mental handicapping conditions. The apparatus includes a motorized spinner, a detachable spinner overlay for adapting the spinner for use in a particular game, one or more capability switches for separately operating the motorized spinner, and structure for mounting the capability switches to permit accessibility and operation by the handicapped persons. The motorized spinner may be used by handicapped persons in lieu of conventional manual spinners, dice, or other random selection mechanisms. The capability switches for operating the motorized spinner may be operable by hands, feet, limbs, head, mouth or other useable body parts of the handicapped players.

20 Claims, 4 Drawing Sheets

GAME APPARATUS FOR THE HANDICAPPED

BACKGROUND OF THE INVENTION

The present invention relates to apparatus providing for joint participation in table games by persons of varying physical and mental handicapping conditions as well as non-handicapped persons. The apparatus permits handicapped persons to play, for example, board games and card games, which many handicapped persons were not previously able to play.

As most people know, table games, such as board games and card games, provide the opportunity for intimate social interaction among family members, while being far more inexpensive than modern day computer and electronic toys and games. Thus, such table games continue today to provide an optimal vehicle for family fun.

Handicapped persons, because of their physical and/or mental handicapping conditions that limit their activities, are in particular need of vehicles for social interaction. They also need experience with cause-and-effect situations, in order to learn to cope with their disabilities and function as independently as possible. Although table games combine both social interaction and cause-and-effect training, such games have not previously been accessible and playable by handicapped persons. Many handicapped persons, particularly the severely handicapped, cannot perform the simple tasks required of table game players, such as spinning a spinner or rolling dice. Thus, handicapped persons have only been able to sit passively by and watch while a non-handicapped or lesser handicapped person performs all of the necessary tasks for the handicapped person.

Such passive observation of table games does not invigorate the handicapped person, and may even increase his feeling of helplessness and consequent lack of dignity and worth. One of life's greatest powers and gifts is "choice," which is not experienced through passive observation. Of course, true social interaction also does not occur from passive observation.

Thus, there remains a need for table games, accessible to and playable by handicapped persons, that provide such handicapped persons with essential cause-and-effect training, the power of "choice," and social interaction with non-handicapped and other handicapped persons.

SUMMARY OF THE INVENTION

Accordingly, the present invention has been developed to overcome the foregoing shortcomings of existing table games.

It is therefore an object of the present invention to provide simple, efficient and cost-effective apparatus permitting joint participation in table games by persons of varying physical and mental handicapping conditions.

It is yet another object of the present invention to provide such an apparatus that is adaptable to various games.

It is still a further object of the present invention to provide such an apparatus that can be efficiently and economically manufactured, and that can be easily utilized by both handicapped and non-handicapped persons together.

Thus, in accordance with one aspect of the present invention the shortcomings of existing table games are overcome by a game apparatus providing for participation in table games by persons having physical and mental handicapping conditions, the game apparatus comprising a motorized spinner and at least one capability switch for operating the motorized spinner. The capability switch may be a push button switch or lever type switch, and the table game may be a board game or card game. The apparatus may further include at least one detachable spinner overlay for adapting the spinner for use in a particular game and/or means for mounting the capability switch to permit accessibility and operation by a handicapped person. The motorized spinner may be freely, manually rotatable when the capability switch is disengaged to permit manual operation of the spinner.

In accordance with another aspect of the present invention, the game apparatus includes a plurality of capability switches for separately operating the motorized spinner. The apparatus may further include means for variously mounting the plurality of capability switches to permit accessibility and operation by a plurality of persons of varying physical and mental handicapping conditions.

In accordance with yet another aspect of the invention, the game apparatus includes at least one game board for a particular game and game pieces for use in conjunction with the at least one game board. The overlay and the game board may include means for detachably attaching the game pieces thereto. The game board may include means for removably concealing information on the game board. The overlay may include numbers corresponding to the numbers on at least one game die, and the numbers may be in braille.

These and other aspects and advantages of the present invention are described in or are apparent from the following detailed description of the preferred embodiments.

BRIEF DESCRIPTION OF THE DRAWINGS

The preferred embodiments are described with reference to the drawings in which.

DESCRIPTION OF THE PREFERRED EMBODIMENTS

Figure 1:
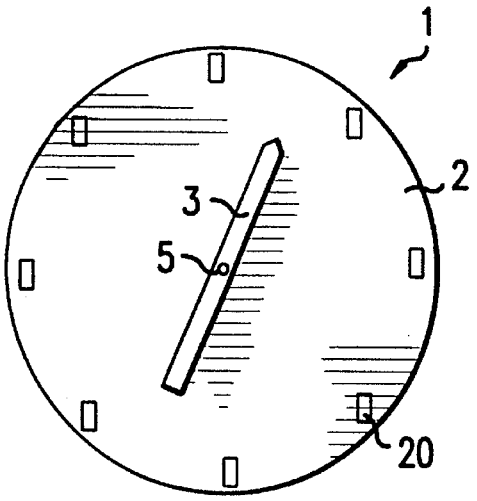
FIG. 1 is a front face view of a motorized spinner according to the present invention.
Figure 2:
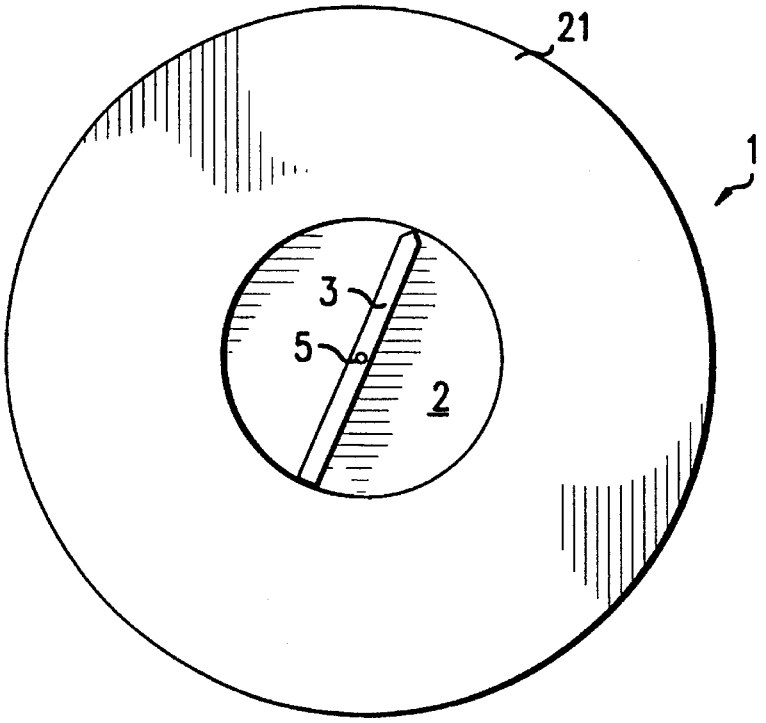
FIG. 2 is a front face view of the motorized spinner of FIG. 1 with a detachable overlay.

The apparatus of the present invention combines a motorized spinner, detachable overlays for adapting the motorized spinner to various table games, such as board games and card games, one or more capability switches for operating the motorized spinner, and structure for variously mounting the capability switches to permit accessibility and operation by persons of varying physical and mental handicapping conditions.

As seen in FIGS. 1–3B, the apparatus includes a motorized spinner 1 that has a front or top face 2, a pointer 3 on one side of the front face, and a motor 4 on the other side of the front face and connected to the pointer via a rotary shaft 5. The motor is preferably a 1.5–4.5 volt D.C. motor contained in a plastic housing and powered by batteries. Pointer 3 is fixedly attached to shaft 5, such that a rotation of shaft 5 by motor 4 also causes pointer 3 to rotate.

Connected to motor 4 via electrical cord 6 is at least one capability switch, such as 7 and/or 8 as shown, for operating motorized spinner 1. A capability switch is a switch designed for accessibility and operability by physically and/or mentally handicapped individuals. Capability switches include large push button switches (7), lever switches (8), rocking plate switches, pillow switches, sip and puff switches, voice-activated switches, pinch switches, string switches, grip and puff switches, and other such well known switches manufactured and/or marketed by such sources as Toys for Special Children—Enabling Devices, Hastings-on-Hudson, New York; Don Johnston Inc., Wauconda, Ill.; and AbleNet Inc., Minneapolis, Minn. Multiple capability switches are accommodated by switch combining mechanisms 9 also manufactured and/or marketed by companies such as those noted above.

Figure 3A:
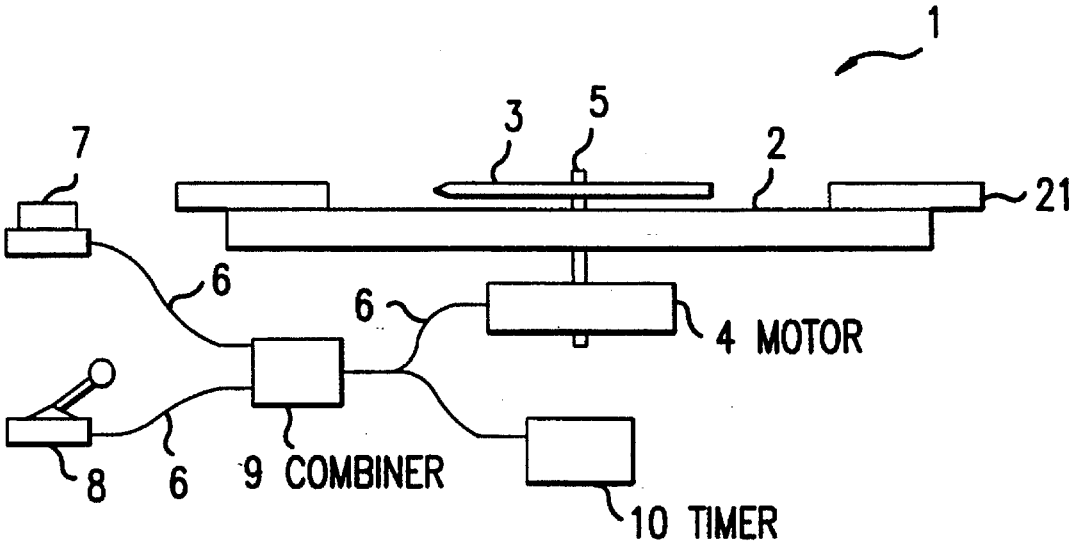
FIG. 3A is an elevation view of the motorized spinner of FIG. 1 with two capability operating switches.
Figure 3B:
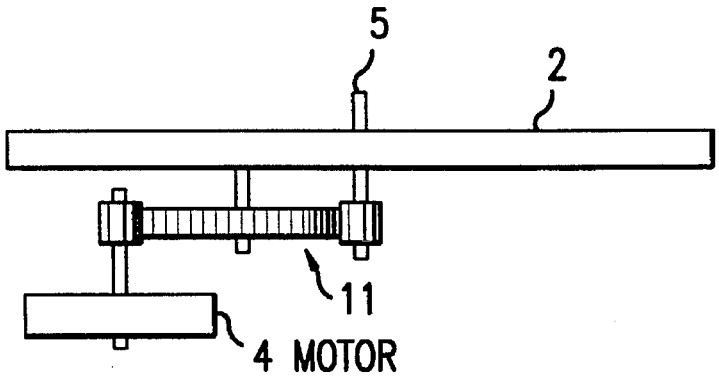
FIG. 3B is an elevation view of a modified motor arrangement for use with the motorized spinner of FIG. 3A.

Motor 4 may be of the direct drive type as shown in FIG. 3A, or an indirect drive type with a clutch arrangement, which permits shaft 5 to be driven by motor 4 when a capability switch is activated but to freely rotate when the capability switch is deactivated. This not only permits pointer 3 to coast to a random stopping point when the capability switch is deactivated, but also permits pointer 3 to be utilized in a conventional, manual fashion by swinging the pointer with one's finger. Alternatively, as shown in FIG. 3B, motor 4 may be of the clutchless indirect drive type, such as is found, for example, in tape players, whereby a gear train 11 or equivalent friction wheel or belt arrangement is used to rotate rotary shaft 5 and to apply a drag to rotary shaft 5 when the capability switch is deactivated to prevent rotary shaft 5 from freely rotating. Additionally, to ensure that a capability switch is not activated for too long a period of time, such as by a severely handicapped person, a conventional timer 10 may be used to limit the length of time that motor 4 is operated by one activation of a capability switch.

Figure 4:
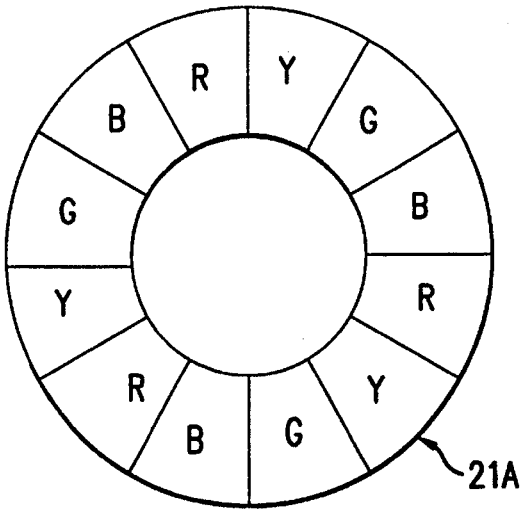
FIG. 4 is a front face view of a first overlay embodiment of the present invention.
Figure 5:
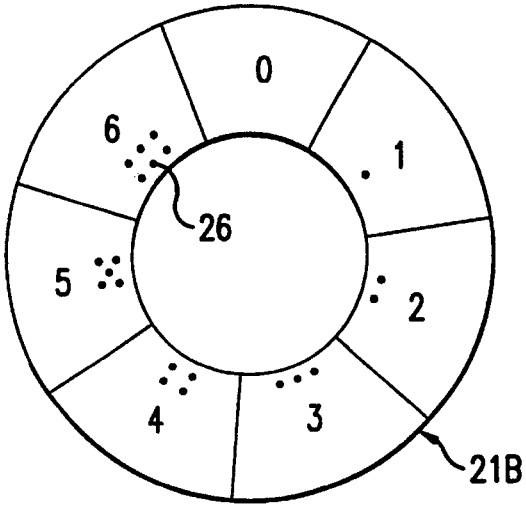
FIG. 5 is a front face view of a second overlay embodiment of the present invention.

Front face 2 of motorized spinner 1 either directly contains game indicia corresponding to a specific game or contains one or more "VELCRO" fasteners 20 (i.e., synthetic materials that adhere when pressed together) or other fastening means for detachably attaching an overlay 21. Overlay 21 is for the purpose of adapting the motorized spinner for use with one of any number of possible games. The side of the overlay facing the motorized spinner contains "VELCRO+ fasteners or other fastening means corresponding to those on the face of the motorized spinner. The front face of the overlay facing away from the motorized spinner contains game indicia. For example, as shown in FIG. 4, the overlay (21A) may contain a series of colored sectors (e.g., red, yellow, green and blue depicted as R, Y, G and B) corresponding, e.g., to the colors along the path of a game board. When the pointer randomly falls on a particular color sector, the player or his assistant moves a game piece to the next corresponding color sector on the game board path or picks a corresponding color card or position on a game board. As shown in FIG. 5, the overlay (21B) may contain numbers corresponding to one or more game dice, with the possible addition of a zero if desired. The overlay may also contain corresponding braille indicia 26 for use by blind persons. As so adapted, the motorized spinner may be used in lieu of dice for any game otherwise played on the basis of dice rolls.

Figure 6A:
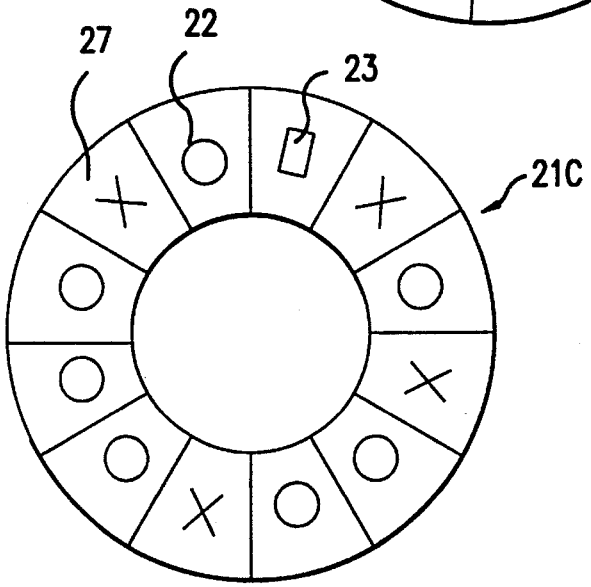
FIGS. 6A and 6B are a front face view of a third overlay embodiment and a corresponding game board of the present invention.
Figure 6B:
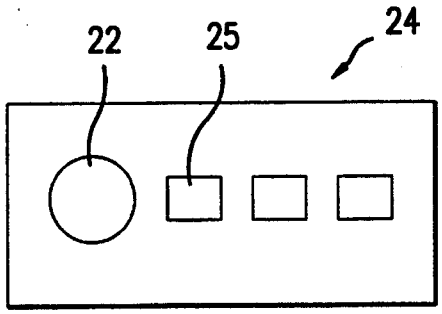

As shown in FIGS. 6A and 6B, the overlay (21C) may also contain a series of detachable collector items 22 attached to the overlay with "VELCRO" fasteners 23 or other fastening means. If the pointer randomly lands on one of the collector items, that player or his assistant removes the collector item from the overlay and places it on a collector game board 24, either loosely or by means of "VELCRO" fasteners 25 or other fastening means on the game board. When the player collects a certain number of collector items on his game board, he wins the game. The overlay may also contain non-detachable positions 27 that, if randomly "landed on" by the pointer, require the player to return one of his collector items to the overlay.

Figure 7:
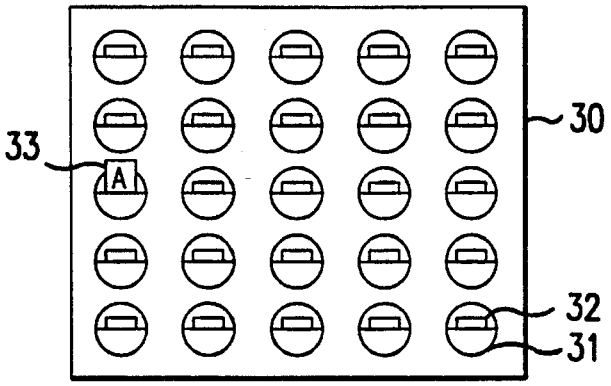
FIG. 7 is a front face view of yet another game board embodiment of the present invention.

Of course, an infinite number of overlays and corresponding game boards may be used with the motorized spinner. The motorized spinner may be adapted to existing commercial games that are played with a manual spinner, dice, or other mechanisms for random selection of indicia, or may be incorporated in newly devised games for the handicapped. For example, the overlay of FIG. 4 may be used in conjunction with the game board 30 depicted in FIG. 7. In this case, each of the spots 31 on game board 30 bears a color corresponding to one of the colors on overlay 21A of FIG. 4. When the pointer randomly "lands on" one of the colors on the overlay, the player or his assistant may pull up a slide tab 32 from within a corresponding color spot 31 to expose a previously concealed letter 33. The object of the game, for example, may be to spell a particular word in some particular direction across the card.

Figure 8:
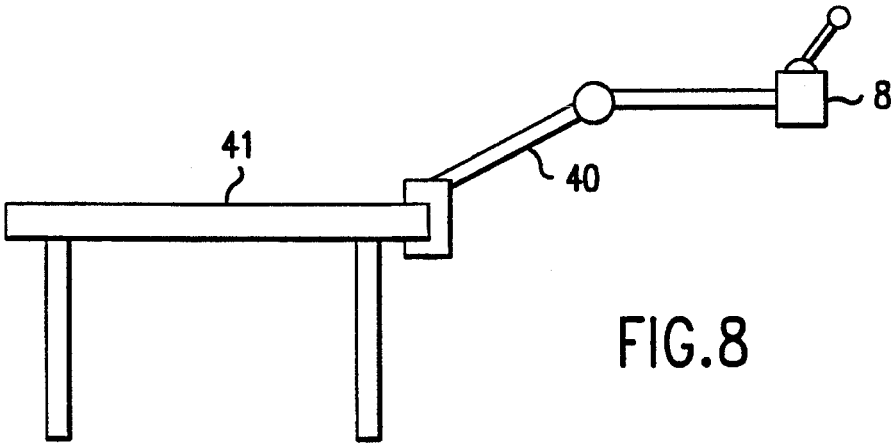
FIG. 8 is an elevation view of one mounting structure embodiment of the present invention.
Figure 9:
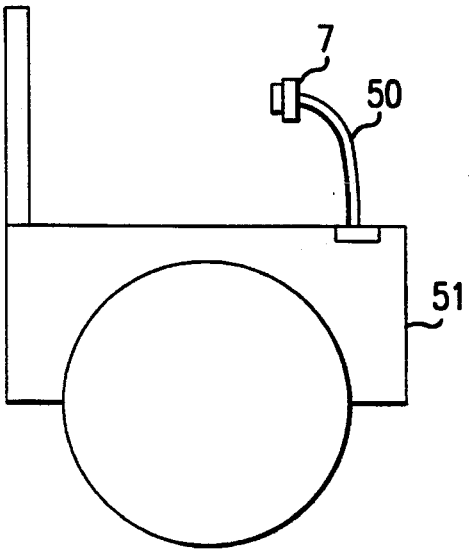
FIG. 9 is an elevation view of a second mounting structure embodiment of the present invention.

To permit the handicapped person to operate a capability switch consistent with his or her particular disability, mounting structures such as structures 40 and 50 of FIGS. 8 and 9 may be used to mount the capability switches to a table 41, wheelchair 51, or other suitable mechanism or vehicle. In this way, the capability switches can be optimally positioned for operation by hands, feet, legs, arms, head, mouth, etc. Such mounting structures are also well known, and are manufactured and marketed by the companies referenced above.

It will be appreciated that the apparatus of the present invention does not permit all handicapped persons to fully participate in table games. Even though a particular handicapped person may be able to operate the motorized spinner with the capability switch, he may very well have to rely upon an assistant to move a game piece on a game board, select a card, pull up a slide tab on a game board, etc. However, even partial participation in table games is far more stimulating than no participation and empowers the handicapped person with at least some ability to exercise his "choice." It also permits the person to directly experience the connection between the "cause" of operating the capability switch and the "effect" of watching the pointer "land on" a particular position on the game overlay. Of equal importance, the apparatus also permits the handicapped person direct social interaction rather than passive observation.

Many modifications and variations to the disclosed apparatus are possible in light of the above teachings. For example, a plurality of spinners with the same or different overlay indicia may be used in conjunction with a particular game, such as when opponents are involved in moves and countermoves. It is therefore to be understood that, within the scope of the appended claims, the invention may be practiced otherwise than as specifically described. In other words, while only certain embodiments of the invention have been specifically described herein, it will be apparent that numerous modifications may be made thereto without departing from the spirit and scope of the invention.

What is claimed is:

1. A game apparatus providing for participation in table games by persons having physical and mental handicapping conditions, said game apparatus comprising:

a motorized spinner for randomly positioning a pointer; and at least one capability switch for operation of said motorized spinner by a handicapped person having at least one of a physical and a mental handicapping condition, said at least one capability switch being structurally separate from the motorized spinner so as to be positionable for optimum accessibility and Operation by said handicapped person.

2. The apparatus of claim 1, further comprising at least one detachable spinner overlay for adapting the spinner for use in a particular game.

3. The apparatus of claim 1, further comprising means for mounting the capability switch to permit said accessibility and operation by said handicapped person.

4. The apparatus of claim 1, wherein said motorized spinner is freely, manually rotatable when said capability switch is disengaged.

5. The apparatus of claim 1, further comprising means for preventing free rotation of said motorized spinner when said capability switch is disengaged.

6. The apparatus of claim 1, further comprising a timer connected between said motorized spinner and said capability switch to limit the length of time that the motorized spinner is operated by one activation of the capability switch.

7. The apparatus of claim 1, comprising a plurality of capability switches for separately operating said motorized spinner, said capability switches being connected to said motorized spinner through at least one switch combining mechanism.

8. The apparatus of claim 7, comprising means for mounting said plurality of capability switches to permit accessibility and operation by a plurality of handicapped persons having at least one of a physical and a mental handicapping condition.

9. An apparatus providing for participation in table games by persons having physical and mental handicapping conditions, said apparatus comprising:

a motorized spinner for randomly positioning a pointer;

at least one detachable spinner overlay for adapting the spinner for use in a particular game;

at least one capability switch for operation of said motorized spinner by a handicapped person having at least one of a physical and a mental handicapping condition, said at least one capability switch being structurally separate from the motorized spinner so as to be positionable for optimum accessibility and operation by said handicapped person; and means for mounting said capability switch to permit said accessibility and operation by said handicapped person.

10. The apparatus of claim 9, comprising a plurality of capability switches for separately operating said motorized spinner, said capability switches being connected to said motorized spinner through at least one switch combining mechanism.

11. The apparatus of claim 10, comprising means for mounting said plurality of capability switches to permit accessibility and operation by a plurality of handicapped persons having at least one of a physical and a mental handicapping condition.

12. The apparatus of claim 9, further comprising a timer connected between said motorized spinner and said capability switch to limit the length of time that the motorized spinner is operated by one activation of the capability switch.

13. The apparatus of claim 9, further comprising at least one game board for a particular game, and game pieces for use in conjunction with the at least one game board.

14. The apparatus of claim 13, wherein said overlay is firmly attachable to said spinner and at least one of said overlay and said game board includes means for firmly attaching and detaching said game pieces thereto.

15. The apparatus of claim 13, wherein said game board includes means for removably concealing information on the game board.

16. The apparatus of claim 9, wherein said overlay includes numbers corresponding to the numbers on at least one game die, said numbers being in at least one of numeric characters and braille.

17. The apparatus of claim 9, comprising a plurality of firmly attachable and detachable spinner overlays for adapting the spinner for use in a plurality of games.

18. An apparatus for providing participation in table games by persons having physical and mental handicapping conditions, said apparatus comprising:

a motorized spinner for randomly positioning a pointer;

a plurality of firmly attachable and detachable spinner overlays for adapting the spinner for use in a plurality of games;

a plurality of capability switches for separate operation of said motorized spinner by a plurality of handicapped persons having at least one of a physical and a mental handicapping condition, said capability switches being structurally separate from the motorized spinner so as to be positionable for optimum accessibility and operation by said handicapped persons; and means for mounting said plurality of capability switches to permit said accessibility and operation by said plurality of handicapped persons.

19. The apparatus of claim 1, wherein said capability switch is selected from the group consisting of push button switches, lever switches, rocking plate switches, pillow switches, sip and puff switches, voice-activated switches, pinch switches, string switches, and grip and puff switches.

20. The apparatus of claim 1, further comprising a plurality of firmly attachable and detachable spinner overlays for adapting the spinner for use in a plurality of games.

* * * * *